United States Patent [19]

Ljungkvist

[11] Patent Number: 4,838,000

[45] Date of Patent: Jun. 13, 1989

[54] ARRANGEMENT FOR IMPROVED VENTILATION AND METHOD OF USING THE ARRANGEMENT

[76] Inventor: Stig-Ake Ljungkvist, Backvagen 34, S-541 35 Skovde, Sweden

[21] Appl. No.: 119,229

[22] Filed: Nov. 5, 1987

Related U.S. Application Data

[63] Continuation of Ser. No. 819,511, filed as PCT SE85/00096 on Feb. 28, 1985, published as WO85/04441 on Oct. 10, 1985, abandoned.

[30] Foreign Application Priority Data

Mar. 22, 1984 [SE] Sweden ..... 8401586

[51] Int. Cl.[4] ..... E04B 1/70; E04B 5/48; E04F 15/18

[52] U.S. Cl. ..... 52/376; 52/480; 52/729; 52/731

[58] Field of Search ..... 52/169.14, 302, 303, 52/376, 368, 480, 572, 404, 484, 729, 730, 731

[56] References Cited

U.S. PATENT DOCUMENTS

| | | | |
|---|---|---|---|
| 1,350,349 | 8/1920 | Walther . | |
| 1,940,933 | 12/1963 | Balduf | 52/376 X |
| 2,227,713 | 1/1941 | Higgins . | |
| 2,805,472 | 6/1937 | Roush | 52/376 |
| 2,862,255 | 12/1958 | Nelson . | |
| 3,566,569 | 3/1971 | Coke et al. . | |
| 4,033,083 | 7/1977 | Fritz et al. | 52/385 |
| 4,133,155 | 1/1979 | Oelrich . | |
| 4,156,999 | 6/1979 | Avery | 52/376 |
| 4,159,604 | 7/1979 | Burrell . | |

FOREIGN PATENT DOCUMENTS

| | | | |
|---|---|---|---|
| 32708 | 12/1907 | Austria | 52/376 |

*Primary Examiner*—David A. Scherbel
*Assistant Examiner*—Richard E. Chilcot, Jr.
*Attorney, Agent, or Firm*—Stevens, Davis, Miller & Mosher

[57] ABSTRACT

A rail (1) of U-shaped section is used as a casing for a bar of wood. The rail has barbs on the inner walls and ribs (4, 3) at the bottom. Tracks extend on the underside of the rail, the said tracks matching tracks on the mountings (2). The rail also has a horizontal support shelf on its outer side. The rail with bars of wood are secured with the aid of the mountings on an underfloor damaged by moisture whereas a material serving to isolate the underfloor is located on the shelves. The said material rests on two support shelves (5) pertaining to the rails and situated at some distance from one another. It is also possible for an insulating material to be placed on top of the isolating material (12, 14). A new flooring material is now fixed on top of the bars. At this stage the space between the underfloor and the isolating material brought about in this way is ventilated naturally or by force. The same method can be used to prevent radon rising through the underfloor from penetrating the premises above.

2 Claims, 2 Drawing Sheets

ARRANGEMENT FOR IMPROVED VENTILATION AND METHOD OF USING THE ARRANGEMENT

No. 819,511 filed as PCT SE85/00096 on Feb. 28, 1985, Published as WO85/04441 on Oct. 10, 1985, now abandoned.

The present invention pertains to the sphere of building technology and describes an arrangement by means of which the problem of moist floors can be solved. The arrangement described and its application can also be used to prevent excessively high radon concentrations in buildings. In this connection it is assumed that the radon emanates from types of soil and rock beneath the house.

Increasing insulating standards in conjunction with the Swedish custom of building living rooms also in the basement or in conjunction with the ever more frequent basement-less houses have caused the problem of moisture to become more severe. Attempts are made to reduce the consumption of energy by reducing ventilation but instead one often gets problems due to residual moisture, which can attack the timber constituting the load-bearing structure of a timber house. Apart from this hazard there is also a danger of fungi and other microbiological activities causing inconvenience or even illnesses to the residents. These and related problems have recently received prominent coverage in the press. At the focus of discussion have been basement-less houses built on a concrete slab, in the construction of which the hazards of poor insulation against moisture have not been taken into account sufficiently.

The present invention is primarily intended to be realised in already existing houses where the problems of moisture are striking. However the method of avoiding problems of moisture as described in the invention can also be used with new constructions.

The causes of moisture penetration can be numerous. Frequently faulty materials and faulty execution of the work contribute to creating a draining foundation beneath a bottom slab. Also ground water changes may occur. Once moisture has penetrated a construction it is impossible, owing to reduced ventilation or quite simply total lack of ventilation, to get rid of the moisture. The damage to property resulting from the processes described above is of national economic significance.

Now the present invention proposes an arrangement with the aid of which the problems described above can as a rule be solved. The main problem, i.e. to create a ventilating space has been solved by a method which at the same time avoids the problem of rotting material. If, as is most common, such a space is created using ordinary wooden laths there is still a risk of moisture from the base being absorbed by the wood so as to cause rotting and associated problems.

The present invention provides a plastic joist with a U-shaped cross-section, i.e. two matching vertical plastic walls with an interconnecting horizontal plastic wall. Matching bars of wood are located within this joist. The bars of wood between walls in turn constitute a base for flooring material such as chipboard panels. Since the space must perhaps be ventilated mechanically, owing to the underlying material being very moist, there is a danger of the floor cooling down too much from the point of view of the residents. That is why the U-shaped plastic joists have at their lower lateral extremities horizontal support shelves, bearing between two joists as shown in FIG. 3 boundary material for the ventilated space. The support shelf is on a side of the vertical wall opposite to the horizontal plastic wall and in alignment therewith. The material may be insulating and impermeable to wind. Examples of such material are bituminous board and mineral wool. These can be used separately or in combination.

The present invention thus described can also serve as a solution for ventilating any radon gases present. In many parts of Sweden the bed-rock is such that radon flows from the latter into properties. Ventilation of the space in the property has proved to be really costly bearing in mind the energy lost as the air is evacuated. One possible alternative consists in heat exchangers, but this solution suffers from the simple fact that it is expensive and that ventilation ducts have to be installed within the property. This may give rise to problems at a later stage bearing in mind all the inlets, and in addition the aesthetic effect may be impaired.

Other details and features of the invention will stand out from the description given below by way of non-limitative example and with reference to the accompanying drawings, in which.

Figure 1:
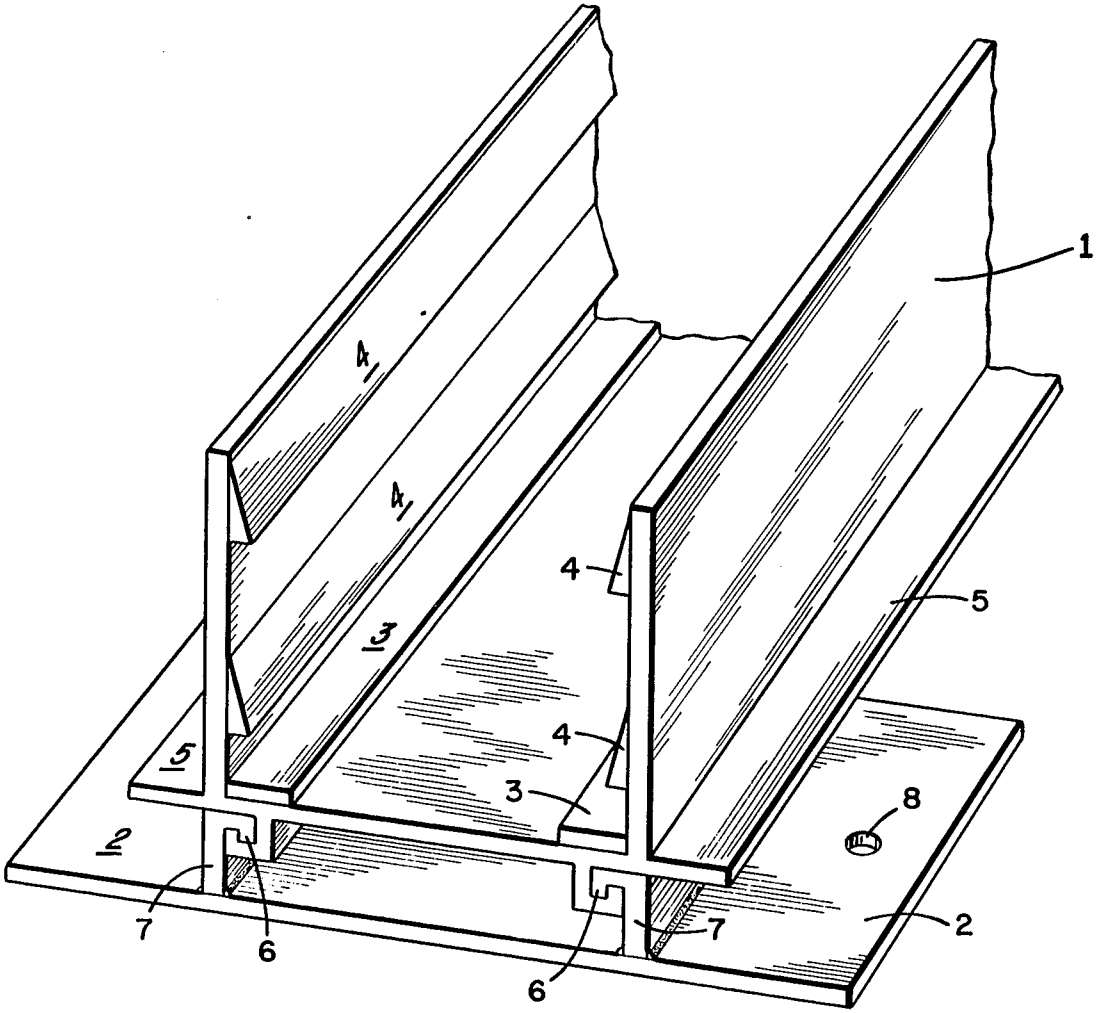
FIG. 1 shows the rail and mounting of the present invention.

FIG. 1 shows joist (1) attached to a mounting (2) provided only over part of the length of the joist. At the bottom within the rail there are ribs (3) serving to create a free space beneath the bars of wood inserted subsequently and the horizontal plastic wall. The free space is to enable removal by ventilation of any residual moisture in the bars of wood. On the inside of the rail there are also barbs (4) which grip the bars of wood once they have been inserted and make it impossible to lift the bars of wood out of the joist. Furthermore a support shelf 5 extends at either side along the joist. These shelves serve to support the material creating the ventilated space. This is described in greater detail in connection with FIG. 3. On the bottom of the joist there is a track (6). This track is matched on the mountings and is described in detail in connection with FIG. 2.

Figure 2:
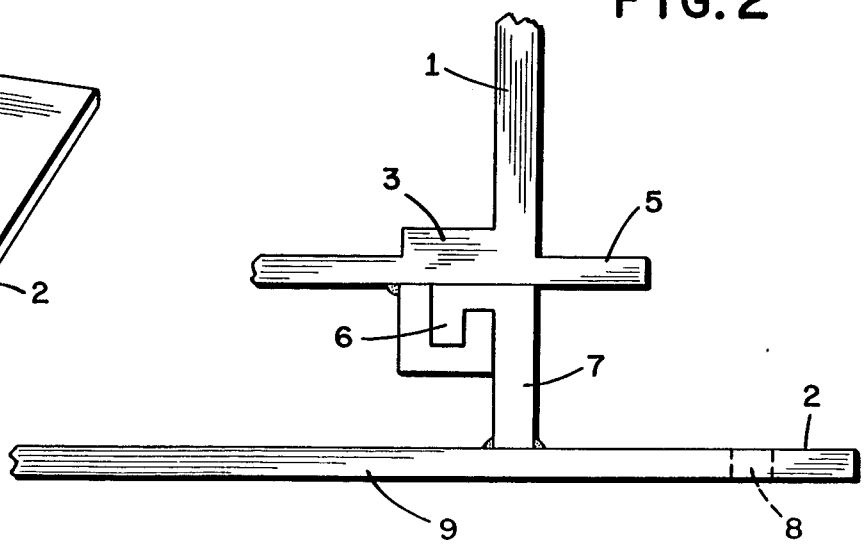
FIG. 2 shows how the tracks of the rail and mounting slidably connect.

FIG. 2 shows a cross-section of that part of the entire arrangement where mounting (2) and joist (1) are fixed to one another so that the parallel vertical walls of the joist are in direct alignment with said parallel rails. The mounting consists of base plate (9) to which is secured a rail (7) which at its top end is bent so as to bring about a track matching a corresponding track in joist (1). The track is so designed as to ensure that no movement can take place except for the movement brought about at the rail when the rail is slid into the mountings provided. The mountings are anchored to the base for instance by screwing them down, in which case use is made of hole (8).

Figure 3:
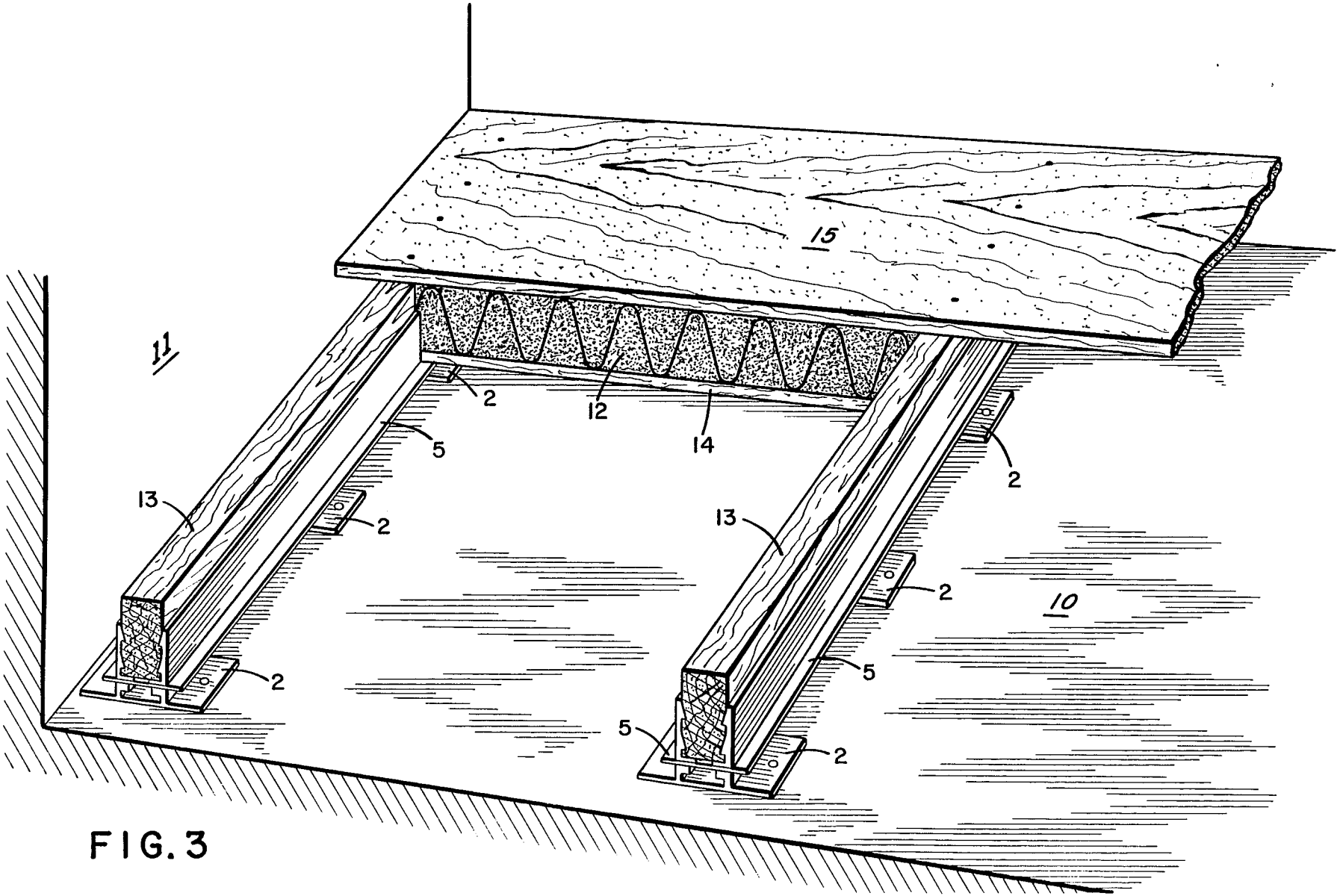
FIG. 3 shows a moisture barrier assembly.

FIG. 3 shows the method by which the ventilated space is brought about. On base (10) are secured a number of mountings (2) at mutually appropriate distances, e.g. in accordance with the 3M system of dimensions. Rails (1) are inserted by sliding into the track as described in FIG. 2. Bars of wood (13) are inserted whereupon e.g. bituminous board (14) is placed on the support shelves (5), the said bituminous board being covered with mineral wool (12) before the flooring material, e.g. chipboard panels (15) is nailed to the bars. By providing one of the rails close to wall (11) it also becomes possible to ventilate the space which is in contact with the vertical wall material containing wood, in order by this means to avoid damage as a result of moisture.

The present invention is primarily intended to be used in existing houses but can also be used in new buildings where there is reason to expect problems due to moisture from the ground.

Within the framework of the above the various details can be designed in numerous different versions. These are not described in detail at this point but shall not, for this reason, be regarded as means for circumventing the principle of the above.

I claim:

1. A moisture barrier for protecting bars of wood against attacks of moisture from one direction comprising a plurality of horizontal mountings having a top side, each mounting defining parallel rails extending at right angles to each of said mountings from the top side thereof and a joist of greater length than a plurality of said mountings slidably mounted on a plurality of said mountings; said joist defined by two vertical parallel plastic walls interconnected by a horizontal plastic wall having top and bottom sides, a longitudinal rib extending along the juncture of each of said vertical plastic walls and said horizontal plastic wall on the top side of said horizontal plastic wall; downwardly extending parallel tracks on the bottom side of said horizontal plastic wall, and a support shelf on a side of each of said vertical walls opposite to said horizontal plastic wall and in alignment therewith, said vertical parallel plastic walls being in direct alignment with said parallel rails, said vertical parallel plastic walls defining barbs on facing surfaces between which surfaces a bar of wood is positionable, said tracks on the bottom side of said horizontal plastic wall being complementary with and slidable relative to said rails of each of said mountings, said tracks holding said rails in contact therewith.

2. A moisture barrier assembly comprising a plurality of horizontal mountings having a top side, each mounting defining parallel rails extending at right angles to each of said mountings from the top side thereof; bars of wood; a plurality of parallel joists each of greater length than a plurality of said mountings slidably mounted on a plurality of said mountings; each said joist defining two vertical parallel plastic walls interconnected by a horizontal plastic wall having top and bottom sides, a longitudinal rib extending along the juncture of each of said vertical plastic walls and said horizontal plastic wall on the top side of said horizontal plastic wall; downwardly extending parallel tracks on the bottom side of said horizontal plastic wall, and a support shelf on a side of each of said vertical walls opposite to said horizontal plastic wall and in alignment therewith, said vertical parallel plastic walls being in direct alignment with said parallel rails, said vertical parallel plastic walls defining barbs on facing surfaces between which surfaces a bar of said wood is positioned, said tracks on the bottom side of said horizontal plastic wall being complementary with and slidable relative to said rails of each of said mountings, said tracks holding said rails in contact therewith; a boundary material mounted between walls of adjacent parallel joists; an insulating material between said adjacent parallel joists and a surface material transversely positioned on said joists and attached to said bars.

* * * * *